US006188422B1

(12) United States Patent
Ogura

(10) Patent No.: US 6,188,422 B1
(45) Date of Patent: Feb. 13, 2001

(54) THERMAL PRINTER CONTROL AND COMPUTER READABLE MEDIUM STORING THERMAL PRINTING CONTROL PROGRAM THEREIN

(75) Inventor: Akio Ogura, Nagoya (JP)

(73) Assignee: Brother Kogyo Kabushiki Kaisha, Nagoya (JP)

( * ) Notice: Under 35 U.S.C. 154(b), the term of this patent shall be extended for 0 days.

(21) Appl. No.: 09/106,010

(22) Filed: Jun. 29, 1998

(30) Foreign Application Priority Data

Jun. 30, 1997 (JP) ..... 9-173328

(51) Int. Cl.[7] ..... B41J 2/32; B41J 2/36; B41J 2/355

(52) U.S. Cl. ..... 347/171

(58) Field of Search ..... 347/211, 188, 347/171; 400/120.01, 120.09

(56) References Cited

U.S. PATENT DOCUMENTS 4,814,789 3/1989 Ono .

FOREIGN PATENT DOCUMENTS 61-197259 * 9/1986 (JP) .
6-83344 10/1994 (JP) .
7-227990 8/1995 (JP) .

* cited by examiner

*Primary Examiner*—Huan Tran
(74) *Attorney, Agent, or Firm*—Oliff & Berridge PLC.

(57) ABSTRACT

A thermal printer apparatus prints an image on a thermal paper by repeating a thermal printing process in which an image is printed on a thermal paper with a printer head in a main scanning direction and a paper advancing process in which the thermal paper is advanced at a unit of predetermined length in a sub-scanning direction. The apparatus determines a paper stop time from a previous paper advancing process and then determines a delay time in correspondence with the determined stop time. The apparatus controls the timing of a next thermal printing process after the determined delay time elapsed from a paper advancing process which precedes the next printing process. The stop time may be determined by the amount of data to be printed and the delay time may be determined in further correspondence with the temperature of the printer head.

12 Claims, 6 Drawing Sheets

THERMAL PRINTER CONTROL AND COMPUTER READABLE MEDIUM STORING THERMAL PRINTING CONTROL PROGRAM THEREIN

CROSS REFERENCE TO RELATED APPLICATION

This application relates to and incorporates herein by reference Japanese Patent Application No. 09-173328 filed on Jun. 30, 1997.

BACKGROUND OF THE INVENTION

1. Field of the Invention

The present invention relates to a thermal printer control and a computer readable medium for printing an image on a printable medium such as a thermal paper by heat generated from a thermal printer head, and particularly relates to a thermal printer control and a computer readable medium by which printing quality may be improved by controlling timings at which an image is printed on a thermal paper even when sticking occurs between a thermal printer head and the thermal paper.

2. Description of Related Art

Heretofore, there is known a thermal printer apparatus for printing an image on a thermal paper serving as a printable medium by discoloring (blackening) the thermal paper with an application of heat generated from a thermal printer head including a heating element. If the thermal paper that has been discolored in the previous printing operation of one line does not advance and remains at the position of the previous printing as shown by the dotted line in FIG. 8A while a feeder roller is in a paper feeding motion as shown by the solid line, the discolored layer of the melted thermal paper is cooled and the thermal paper sticks to the heating element of the printer head. As a result, as shown in FIG. 8B, although an image of the next line is printed, the thermal paper 10 does not advance to the next position and the next image is not printed on the next position, thereby resulting in an image of each line 52 being printed on the same position repeatedly. This produces a void (whitening or printed image dropout) on the thermal paper.

It is proposed to prevent this sticking by lowering the quantity of heat of the printer head. However, according to this method, as the heat is not sufficiently applied to thermal paper, an image cannot be printed on the thermal paper with proper density. For this reason, there are also proposed various apparatuses which prevents sticking between a thermal paper and a printer head so that an image can be reliably printed on the thermal paper without lowering the quantity of heat of the printer head when an image is printed on the thermal paper.

Japanese Examined Patent Publication No. Hei 6-83344 proposes that, in a printing mode of a long printing cycle in which sticking tends to occur, after printing of an image of a predetermined amount is finished, a printer head and a thermal paper are immediately moved relatively to prevent sticking.

Japanese Unexamined Patent Publication No. Hei 7-227990 proposes that, in a low speed thermal paper feeding mode in which sticking ends to occur, an image is printed after image data of predetermined lines is accumulated in a memory. In actual practice, the thermal paper is advanced at a comparatively high speed, thereby preventing occurrence of sticking.

However, the conventional apparatuses are unable to control timings at which an image is printed on the thermal paper. Therefore, if sticking occurs for some reason, then the printing timing becomes inappropriate. Thus, a printed image dropout occurs and a printing quality is lowered.

SUMMARY OF THE INVENTION

It is an object of the present invention to provide a thermal printer control and a computer readable storage medium which prevents, even when sticking occurs, occurrence of printed image dropout or the like by controlling timings at which an image is printed on a printable medium.

According to the present invention, a thermal paper stop time after a previous paper advance is determined and a delay time is determined in accordance with the paper stop time in which a thermal printing process is effected. The next thermal printing process is effected after the thus determined delay time from a completion of a next paper advancing process. Thus, even when a thermal paper sticks to a thermal printer head, each thermal printing process can be executed after the thermal paper is advanced to a next printing position, thereby preventing the occurrence of printed image dropout.

Preferably, the paper stop time is represented by data to be printed and the delay time is stored in the data table memory in correspondence with the stop time so that the stop time and the delay time may be determined without actual measurement and mathematical calculation for controlling the next printing process.

More preferably, the temperature of the printer head is detected and the delay time is determined from both of the stop time and the detected temperature.

BRIEF DESCRIPTION OF THE DRAWINGS

Other objects, features and advantages of the present invention will become more apparent from the following detailed description made with reference to the accompanying drawings. In the accompanying drawings.

DETAILED DESCRIPTION OF THE PREFERRED EMBODIMENT

Figure 1:
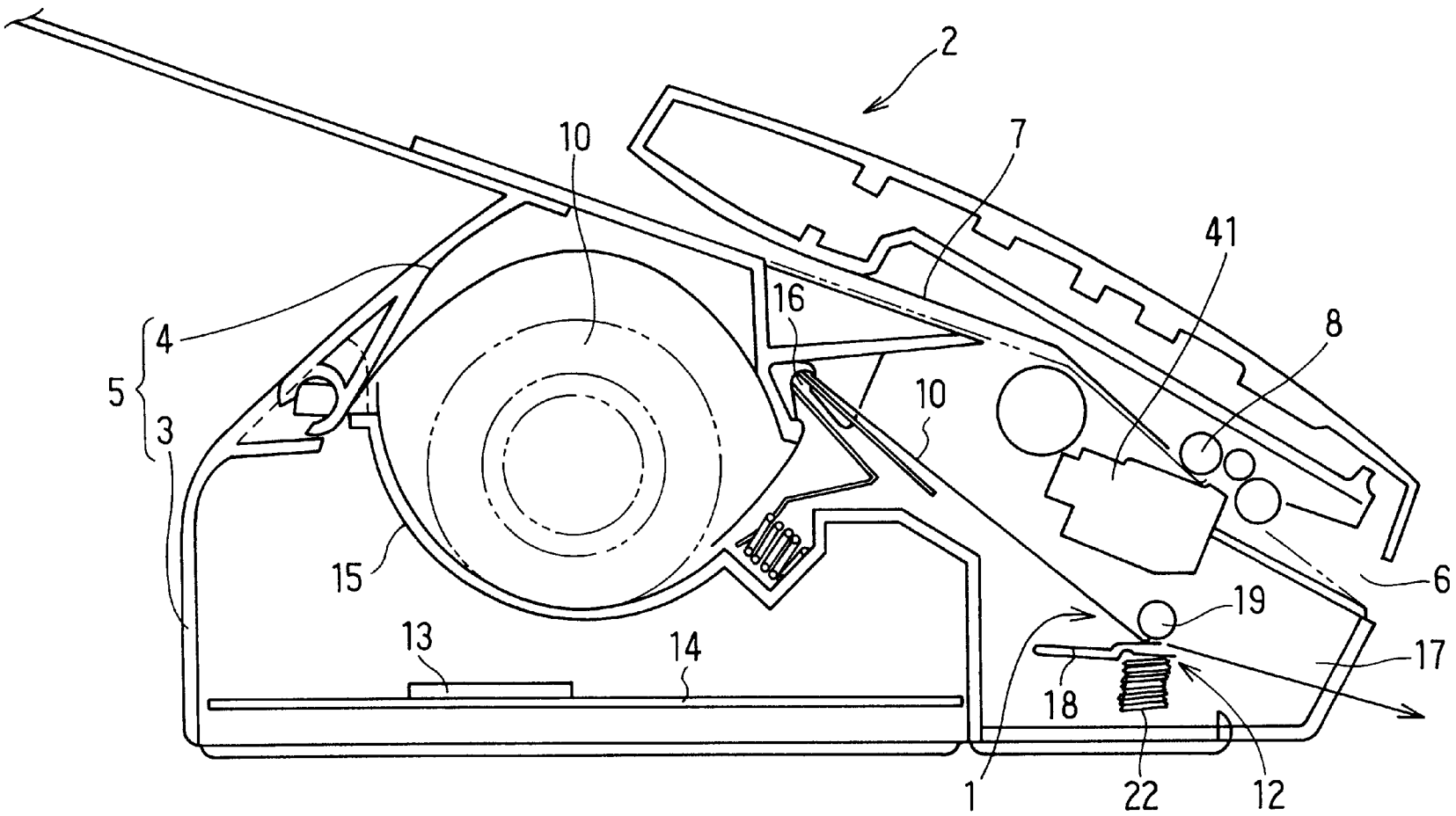
FIG. 1 is a schematic view showing a thermal printer apparatus according to an embodiment of the present invention.

Referring first to FIG. 1, a thermal printer apparatus 1 is used in a facsimile machine 2 for thermally printing an image on a thermal paper 10 as a printable medium. The facsimile machine 2 has an apparatus body 5 including a lower cover 3 and an upper cover 4 and a telephone receiver handset (not shown). The apparatus body 5 has a feeder roller 8 for discharging an original document 7 from a discharge opening 6 and encases a CCD (charge-coupled device) 41 for reading an image from the document 7. After the document 7 is inserted into the facsimile machine 2 from above the upper cover 4, an image of the document 7 is read out by the CCD 41, and the document 7 is discharged from the discharge opening 6.

The apparatus body 5 encases also a roll of thermal paper 10 and an electronic control circuit 13 for controlling the whole operation of the facsimile machine 2 including the thermal printer apparatus. The control circuit 13 operates so that an image of received facsimile data or an image of the original document 7 read out by the CCD 41 can be printed on the thermal paper 10.

The lower cover 3 encases a base plate 14 which supports the control circuit 13 thereon. A housing cover 15 for housing the rolled thermal paper 10 is provided above the control circuit 13. The housing cover 15 houses therein the thermal paper 10 in a roll shape. The upper cover 4 is supported swingably around the upper portion of the housing cover 15 to open and close in such a manner that a roll of the thermal paper 10 can be removed and can be replaced with another roll. Specifically, the upper cover 4 is shaped like a hatch that can be opened and closed about the upper portion of the side surfaces of the lower cover 3. In the apparatus body 5, when the upper cover 4 is opened, the roll of thermal paper 10 can be housed within the housing cover 15.

The housing cover 15 has on its open end side a guide 16 for guiding the unrolled thermal paper 10 to the thermal printer apparatus 1 while the curl is being removed from the thermal paper 10. Also, the apparatus body 5 is arranged such that the thermal paper 10 printed by the thermal printer apparatus 1 is advanced to a discharge opening 17.

The thermal printer apparatus 1 includes a thermal printer head 12 having a heating element 18 and a feeder roller 19 pivotally provided at the position opposing the printer head 12. The heating element 18 comprises a plurality of heating members arrayed along the paper width direction (main scanning direction or printing line direction) of the thermal paper 10. When the heating members are selectively heated in response to a signal from the head controller 36, heat is applied to the thermal paper 10 advanced over the heating element 18 so that the printing of one line is executed in the main scanning direction.

The printer head 12 includes on its lower portion resilient members 22 which urge the printer head 12 against the feeder roller 19. Since the thermal paper 10 is advanced into the clearance between the feeder roller 19 and the heating element 18 of the printer head 12 and the printer head 12 is pushed toward the feeder roller 19 by the resilient members 22, the thermal paper 10 is supported by the printer head 12 and the feeder roller 19. The thermal paper 10 printed by the printer head 12 is cut by a cutter (not shown) disposed on the downstream side of the printer head 12, and then discharged from a discharge opening 17 to the outside of the printer apparatus 1.

The feeder roller 19 advances the thermal paper 10 at a unit of predetermined length after the printer head 12 prints data of one line on the thermal paper 10. This predetermined length is a movement or advance amount of the paper height direction (sub-scanning direction) required by the printer head 12 to print data of the next line. Specifically, the feeder roller 19 is arranged so as to repeat the process in which each time data of one line is printed on the thermal paper 10. That is, the feeder roller 19 rotates to advance the thermal paper 10 by the predetermined amount and the data of the next line is printed on the thermal paper 10.

The printer head 12 incorporates therein a thermistor 12*a* (FIG. 2) which changes its electric resistance in response to the temperature of the printer head 12. The change in a resistance value of this thermistor is supplied to an A/D (analog-to-digital) converter 3 (FIG. 2), in which it is converted into a digital value for calculation of a printer head temperature. This head temperature is used in a thermal printing time determination process because it is one of the main factors which cause sticking. That is, as the temperature of the heating element 18 increases, the discolored layer of the thermal paper 10 tends to be melted so that a sticking force between the thermal paper 10 and the heating element 18 increases.

Figure 2:
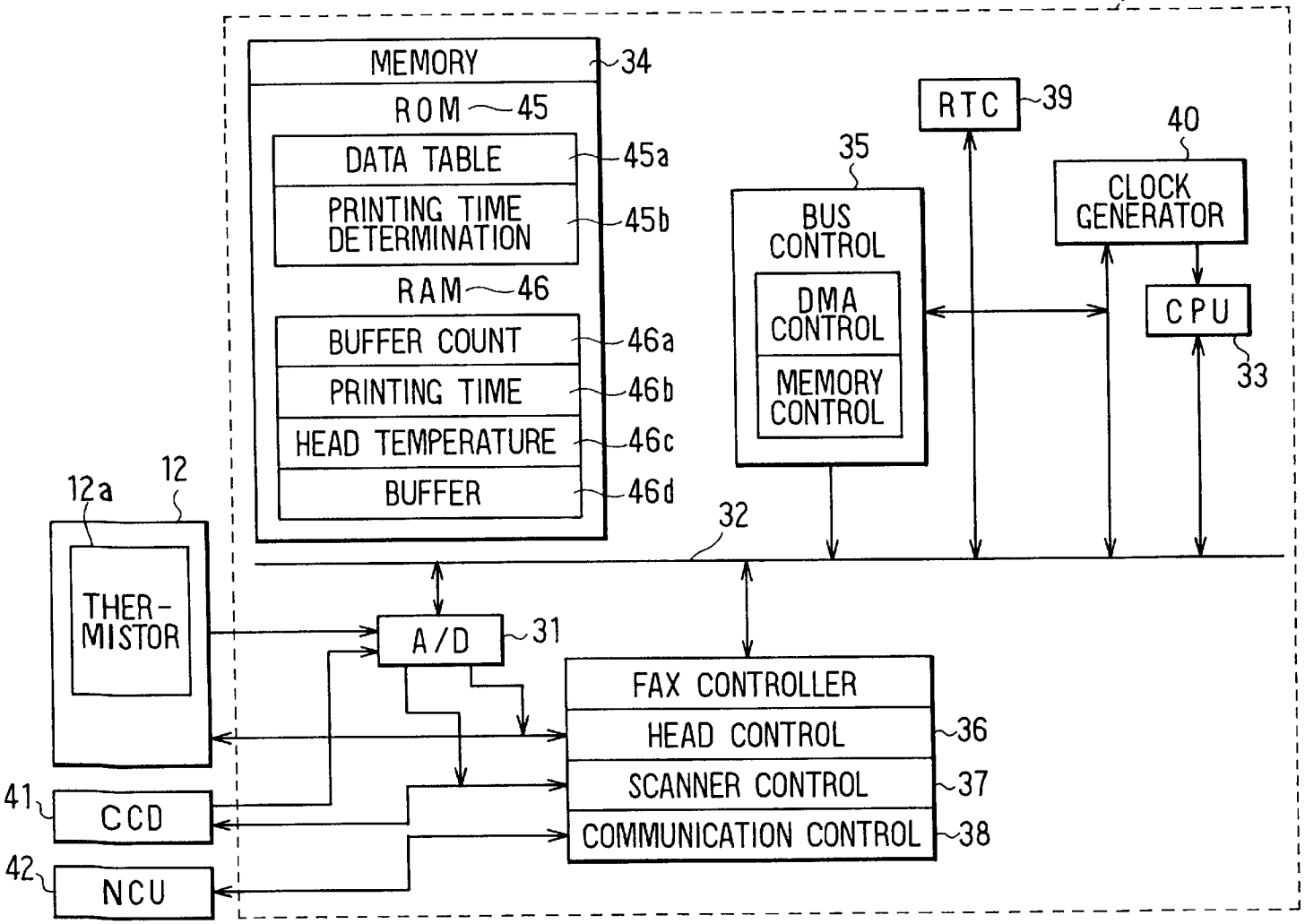
FIG. 2 is a block diagram showing a thermal printer control circuit in the thermal printer apparatus.

As shown in FIG. 2, the control circuit 13 which controls the facsimile machine 2 including the printer apparatus 1 is connected to the CCD 41 for reading out an image from the original document 7 and an NCU (network control unit) 42. The control circuit 13 includes, in addition to the A/D converter 31 connected to the printer head 12, various controllers such as a CPU (central-process unit) 33, a memory 34, an RTC (real time clock) 39, a clock generator 40 and a bus controller 35 connected via a signal bus 32.

The A/D converter 31 converts the image of the document read out from the document by the CCD 41 into a digital value and outputs the digital value as a transmitted value. Also, the A/D converter 31 converts the temperature detected by the thermistor of the printer head 12 into a digital value, and outputs the digital value as a head temperature.

The CPU 33 executes a variety of processes in accordance with a variety of programs memorized in the memory 34. The head controller 36 outputs a signal corresponding to print image data (print data) to the heating element 18 of the printer head 12, thereby printing an image on the thermal paper 10. The head controller 36 starts to rotate the feeder roller 19 through a drive motor (not shown) based on a paper advance signal from the CPU 33.

The memory 34 memorizes a variety of data and control programs, etc., and includes a ROM (read-only memory) 45 and a RAM (random-access memory) 46. The RAM 46 includes a buffer (a printing data memory) 46*d* of a plurality of lines (13 lines in this embodiment) to store a received value received through a modem (not shown). In this buffer 46*d*, there is sequentially stored such one which results from converting the received value into image data by a decoding process with a decoder (not shown). When image data of a predetermined amount (e.g., one line amount) is stored in the buffer 46*d*, the head controller 36 outputs a signal corresponding to the image data to the heating element 18 of the printer head 12 thereby to print an image on the thermal paper 10.

The RAM 46 includes a buffer count memory area 46*a*, a thermal printing time memory area 46*b* and a head temperature memory area 46*c*. In the buffer count memory area 46*a*, there are stored two values of "current buffer count value" indicating how much lines of image data are stored in the buffer 46*d* at the printing start time point and "previous buffer count value". These values are updated in each detection. In the thermal printing time memory area 46*b*, there is stored a thermal printing time determined by a thermal printing time determination routine. In the head temperature memory area 46*c,* there is stored a head temperature which is calculated from the resistance value of the thermistor of the printer head 12.

In the ROM 45, there are stored a data table 45*a* and a thermal printer control program (FIGS. 3 and 4)including a printing time determination routine 45*b* to be executed by the CPU 33. Specifically, the data table 45*b* stores in the following table form a fixed relation among buffer counts, printer head temperatures, delay times, stop times, paper advancing intervals and thermal printing times.

DATA TABLE

| BUFFER COUNT (k) | PRINTER HEAD TEMPERATURE | DELAY TIME | PAPER STOP TIME | PAPER ADVANCING INTERVAL | THERMAL PRINTING TIME |
|---|---|---|---|---|---|
| 1 | t11 | a11 | 56 ms | 60 ms | 4 + a11 |
| | t12 | a12 | | | 4 + a12 |
| | t13 | a13 | | | 4 + a13 |
| | . | . | | | . |
| | . | . | | | . |
| | . | . | | | . |
| | t1j | a1j | | | 4 + a1j |
| | . | . | | | . |
| | . | . | | | . |
| | . | . | | | . |
| | t1n | a1n | | | 4 + a1n |
| 2 | t2j | a2j | 36 ms | 40 ms | 4 + a2j |
| 3 | t3j | a3j | 16 ms | 20 ms | 4 + a3j |
| 4 | t4j | a4j | 6 ms | 10 ms | 4 + a4j |
| 5 | t5j | a5j | 4 ms | 8 ms | 4 + a5j |
| 6 | t6j | a6j | 2.5 ms | 6.5 ms | 4 + a6j |
| 7 | t7j | a7j | 2 ms | 6 ms | 4 + a7j |
| 8 | t8j | a8j | 1 ms | 5 ms | 4 + a8j |

In the above table, the buffer count (k) indicates how much line data are stored in the buffer 46*d* within the RAM 46 at the time the printing is started. According to this embodiment, the buffer 46 is capable of storing a maximum 13 line data (data corresponding to 13 lines). It is indicated how much lines of image data are presently stored.

Figure 5A:
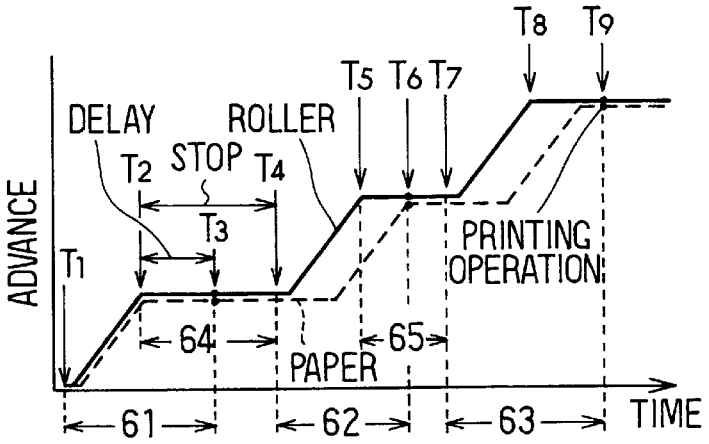
FIG. 5A is a time chart showing operation of the thermal printer apparatus.

The stop time indicates a time interval 64 from time (T2) at which the feeder roller 19 is stopped to time (T4) at which the head controller 36 receives the next paper advance signal as shown in FIG. 5A. The stop time obtained when the buffer count is 1, for example, is "56" ms.

The delay time indicates time interval from time (T2) at which the feeder roller 19 is stopped to time (T3) at which the thermal printing process is executed actually by the printer head 12. This delay time indicates a time interval by which the advance of the thermal paper 10 is delayed after the feeder roller 19 is stopped. Specifically, when the thermal paper 10 sticks to the heating element 18, the advance of the thermal paper 10 is not started at the same time the feeder roller 19 starts to rotate, and the advance of the thermal paper 10 is started with a small delay time. Accordingly, the delay time means a time interval from the stop of the feeder roller 19 to time at which the advance of the thermal paper 10 is started. This delay time is determined by the above stop time and the printer head temperature, and may be determined experimentally and stored as the mapped table data.

Specifically, when the buffer count is "1", the delay time becomes "a1j" ms depending on the head temperature "t1j" ° C. Here, the delay time a1j is "a11≦a1j≦a1n". As described above, the relationship between the delay time and the buffer count (1≦k≦13) is "a1j≦delay time≦a7j" when the buffer count is "1≦k≦7". Also, when the buffer count k is "8≦k≦13", the delay time all becomes "a8j" ms uniformly. Further, the range of j is "1≦j≦n", the printer head temperature is divided into "n" stages. There are also provided "n" patterns for the delay time.

Figure 5B:
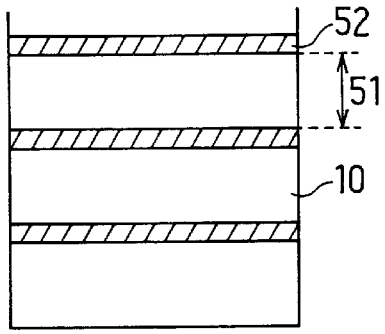
FIG. 5B is a schematic view showing a thermal paper printed by the thermal printer apparatus.

As shown in FIG. 5B, for example, the thermal printing time is a time interval 61 ranging from time (T1) at which the head controller 36 receives the paper advance start signal (roller rotation start) from the CPU 33 to time (T3) at which the thermal printing process is executed by the printer head 12. The thermal printing time results from adding the above delay time to time "4" ms ranging from the time (T1) at which the printer head 12 receives the paper advance start signal to the time (T2) at which the feeder roller 19 is stopped. Specifically, when the buffer count is "1", the thermal printing time is "4+a1j" ms. When the buffer count is "8≦k≦13", the thermal printing time is all uniformly "4+a8j" ms similarly as the delay time is uniform. Although the time ranging from the time (T1) at which the head controller 36 receives the paper advance start signal to the time (T2) at which the feeder roller 19 is stopped is "4" ms as described above, the time from T1 to T2 is not limited thereto.

As shown in FIG. 5A, for example, the paper advance interval is an interval ranging from time (T1) at which the head controller 36 receives the paper advance signal from the CPU 33 to time (T4) at which the head controller 36 receives the next paper advance signal. The paper advance interval is a time interval which results from adding the paper advance time "4" ms to the stop time.

The printer head temperature is detected by the thermistor of the printer head 12. A head temperature "t1j" ° C., for example, indicates the temperature of the printer head 12 detected when the buffer count is "1". Here, the range of the head temperature "t1j" ° C. is "t11° C.≦t1j° C.≦t1n° C.".

The above thermal printing time determination routine 45*b* executes the determination process of the thermal printing time (timing of the thermal printing executed by the printer head 12). Specifically, the thermal printing time determination routine 45*b* determines a buffer count to be referred to in the data table 45*a* based on the present buffer count and the previous buffer count in the buffer count memory area 46*a,* and determines the thermal printing time based on the value of the thus determined buffer count and the head temperature within the head temperature memory area 46*c*.

More specifically, the delay time indicates the time interval by which the advance of the thermal paper 10 is delayed as the feeder roller 19 rotates when the thermal paper 10 sticks to the heating element 18. This embodiment executes the thermal printing process after the delay time elapsed. Accordingly, in order to determine the delay time, it is necessary to calculate the previous stop time. The reason for this is that the delay time is mainly determined in response to the time (stop time) by which the feeder roller 19 is stopped.

According to this embodiment, the relationship among the stop time, the head temperature and the delay time is measured experimentally and memorized in the data table 45*a* so that the thermal printing time is determined variably. That is, the stop time is determined based on the buffer count, and the next thermal printing time is determined by adding the time "4" ms necessary for advancing the thermal paper 10 to the delay time determined in response to the stop time and the head temperature. Then, the timing of the thermal printing process is calculated. Accordingly, since the delay time corresponding to the stop time is previously stored in the data table 45*a,* the CPU 33 need not execute a computing process for computing the stop time and the delay time and can easily calculate the thermal printing time.

The bus controller 35 executes other processes at the same time as the processes of the CPU 33. Also, a scanner controller 37 is connected to the CCD 41 to control the CCD 41. Specifically, the scanner controller 37 transmits an image reading start signal to the CCD 41 so as to read an image of a document A communication controller 38 is connected to the NCU 42 to control the NCU 42.

The RTC 39 and the clock generator 40 receive a thermal printing time count start command from the CPU 33 and start the counting of the thermal printing time at the same time the head controller 36 receives the paper advance signal.

The thermal printer apparatus 1 thus constructed calculates the thermal printing time based on the stop time of the feeder roller 19 and the head temperature in the thermal printing time determination routine 45*b* stored in the ROM 45, calculates a thermal printing process timing at which a head driving voltage is applied to the heating element 18 of the printer head 12 to print data on the thermal paper 10.

Figure 3:
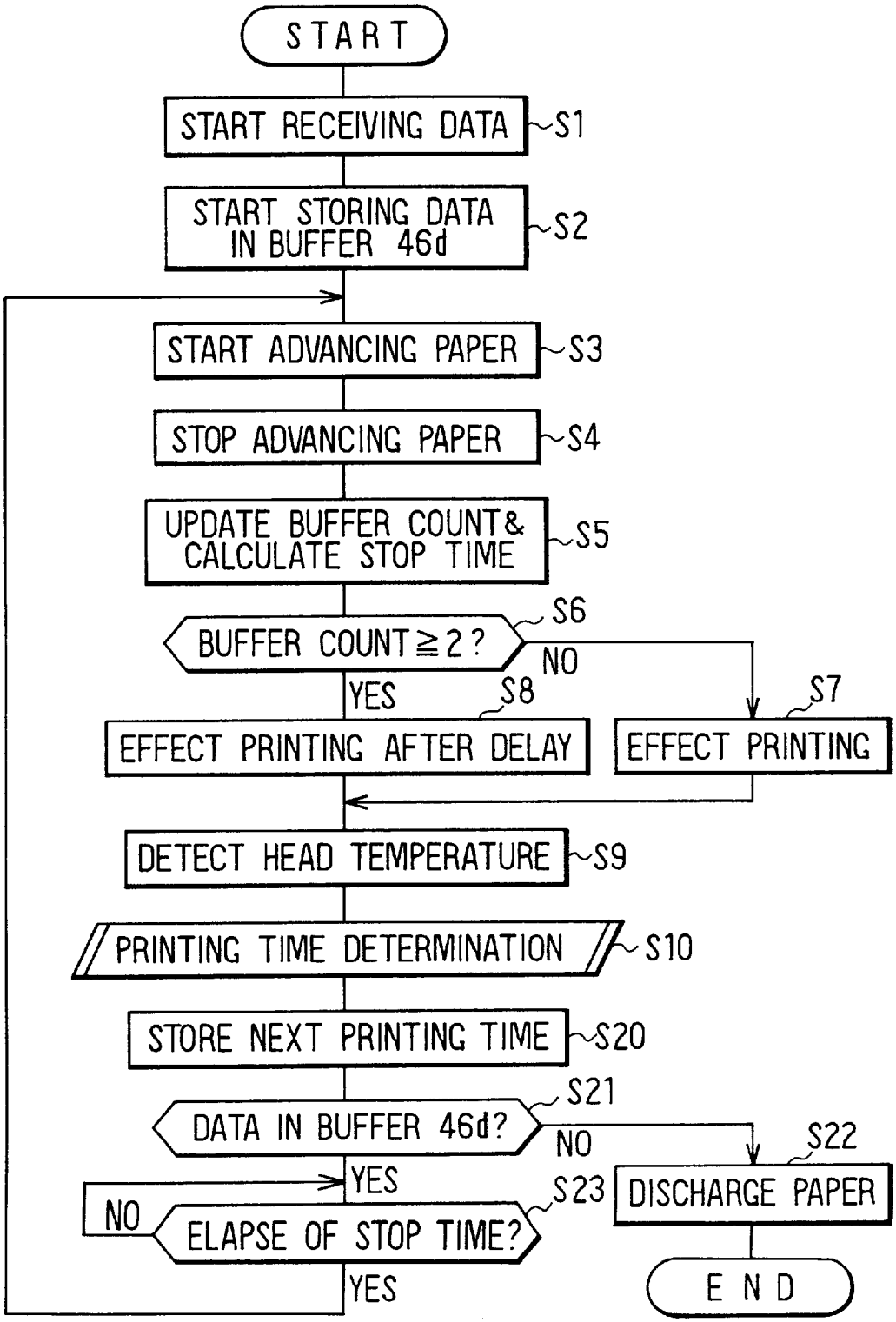
FIG. 3 is a flowchart showing a thermal printing process executed by the printer control circuit.

The CPU 33 and its associated circuit operates as follows. First, as shown in FIG. 3, when the facsimile machine 2 receives image data to be printed from a document through a modem at step S1, the received image data is processed by a suitable process such as a decoding to provide image data, and the image data is sequentially stored in the buffer 46*d* within the RAM 46 at step S2. When the image data is stored in the buffer 46*d,* as shown in FIG. 5A, the CPU 33 outputs to the head controller 36 a paper advance signal instructing the start of paper advance by the feeder roller 19 (T1 in FIG. 5A). Then, the drive motor (not shown) start the rotation of the feeder roller 19 based on the paper advance signal at step S3, so that the thermal paper 10 is advanced at a unit of predetermined length until the thermal paper 10 reaches a predetermined printing position. When the thermal paper 10 is advanced to the predetermined position, the feeder roller 19 is stopped at step S4 (T2 in FIG. 5A). Then, the CPU 33 detects how much lines of image data are stored in the buffer 46*d,* i.e., reads the buffer count (k), and the detected value is stored in the current buffer count value within the buffer count printing area 46 at step S5 (T2 to T3 in FIG. 5A). At this time, the value which has been stored as the current buffer count value is stored in the previous buffer count value. Also, at the same time, the stop time corresponding to the current buffer count value is calculated or determined from the data table 45*a* by a table look-up thus updating the current buffer count value.

Subsequently, it is determined whether or not a buffer count value not less than "2" is stored in the current buffer count of the buffer count memory area 46*a* at step S6. If it is determined that the value not less than "2" is not stored in the current buffer count value (NO at step S6), then a thermal printing process signal is outputted in such a manner that the head driving voltage is applied through the head controller 36 to the printer head 12 after a predetermined time elapsed, and the thermal printing process based on the image data memorized in the buffer 46*d* is effected on the thermal paper 10 at step S7 (T3 in FIG. 5A).

After the thermal printing process is effected on the thermal paper 10, the head temperature is detected from the resistance value of the thermistor of the printer head 12, and stored in the head temperature memory area 46*c* within the RAM 46 at step S9. Then, there is executed the thermal printing time determination routine (FIG. 4) at step S10 (T3 to T6 in FIG. 5A). According to this thermal printing time determination routine, the thermal printing time for executing the thermal printing (T6) of the next line is calculated and stored in the thermal printing time memory area 46*b* within the RAM 46 at step S20. When the value of the previous buffer count is not stored, the value of the previous buffer count is 0.

When the next thermal printing time is thus stored, it is determined by the CPU 33 whether or not data to be printed more exists within the buffer 46*d* at step S21. If print data exists within the buffer 46*d* (YES at step S21), then control moves to step S23. In step S23, it is determined whether or not the stop time calculated at step S5 elapsed. If the stop time elapsed (YES at step S23), the control returns to step S3 to advance further the thermal paper 10 for the next printing. If on the other hand data does not exist within the buffer 46*d* (NO at step S21), control moves to a paper discharging process at step S22, and the present process is ended.

On the other hand, if it is determined at step S6 that the paper advancing process is repeated as in the time T5 in FIG. 5A and the buffer count value not less than 2 is stored in the buffer count memory area 46*a* (YES in step S6), then when the current thermal printing time 62, i.e., the previously calculated time stored in the thermal printing time memory area 46*b* elapses (T6 in FIG. 5A), the heating signal is outputted in such a manner that the head driving voltage is applied through the head controller 36 to the printer head 12, and the thermal printing process is effected on the thermal paper 10 at step S8 (T6 in FIG. 5A).

After the thermal printing process is executed, the head temperature is detected from the resistance value of the thermistor of the printer head 12, and stored in the head temperature memory area 46*c* within the RAM 46 at step S9. Then, when the head temperature is stored in the head temperature memory area 46*c,* the CPU 33 executes the thermal printing time determination routine 45*b* at step S10 (T6 to T9 in FIG. 5A).

Figure 4:
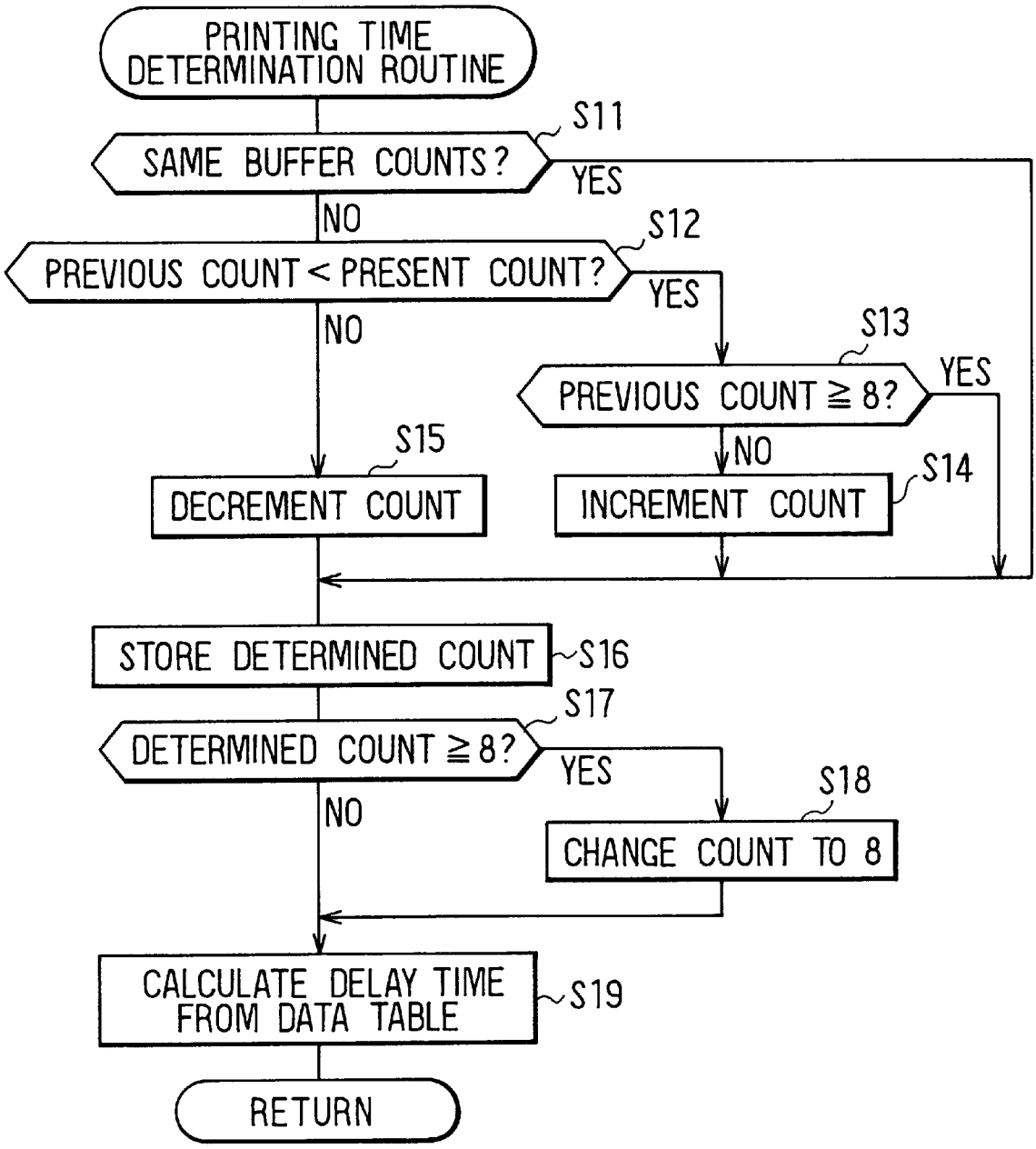
FIG. 4 is a flowchart showing a thermal printing time determination process executed by the printer control circuit.

Referring to the thermal printing time determination routine at step S10 shown in detail in FIG. 4, the buffer count value of the previous time (T2 in FIG. 5A) determined when the thermal printing time determination routine is executed before is read out from the buffer memory area 46*b* within the RAM 46 by the CPU 33. Then, it is determined whether or not the buffer count value of the previous time (T2 in FIG. 5A) and the buffer count value of the present time (T5 in FIG. 5A) calculated at step S5 in FIG. 3 are the same at step S11. If it is determined that the buffer count values are equal to each other (YES at step S11), then the buffer count value of the present time is stored in a register (not shown) at step S16.

When the buffer count value of the present time (T5 in FIG. 5A) is stored in the register, it is determined whether or not the value is not less than 8 at step S17. If the buffer count value in the register is not less than 8 (YES at step S17), then it is assumed that the value of the buffer count is "8", and the value in the register is changed to "8" at step S18. Then, the head temperature at time T6 in FIG. 5A is read out from the head temperature memory area 46*c,* and the thermal printing time 63 for the printing of the next time (T9 in FIG. 5A) is calculated from the value "8" of the buffer count and the head temperature at time T6 stored in the register based on the data within the data table 45*a* at step S19. If on the other hand the value of the buffer count in the register is smaller than "8" (No at step S17), then the head temperature at time T6 is read out from the head temperature memory area 46*c,* and the thermal printing time 63 for the printing of the next time (T9 in FIG. 5A) corresponding to the buffer count value and the head temperature stored in the register is calculated based on the data within the data table 45*a* at step S19.

If the value of the buffer count of the previous time (T2 in FIG. 5A) within the buffer count memory area 46*a* and the value of the buffer count of the present time (T5 in FIG. 5A) are different from each other (NO at step S11), then it is determined whether or not the value of the buffer count of the previous time is smaller than the value of the buffer count of the present time at step S12. If the value of the buffer count of the previous time is larger than the value of the buffer count of the present time (No at step S12), then the value of the buffer count of the previous time (T2 in FIG. 5A) is decremented by 1 and the resultant value is stored in the register (not shown) as the value of the determined buffer count at step S16. After the value of the above determined count is stored in the register, it is determined whether or not the value of the determined buffer count is not less than 8 at step S17. If the value of the determined buffer count is not less than 8 (YES at step S17), then it is assumed that the value of the determined buffer count is "8", and the value in the register is changed to "8" at step S18. Then, the thermal printing time 63 of the next time is calculated based on the data table 45*a* in the similar manner at step S19. If on the other hand the value of the determined buffer count is smaller than "8" (NO at step S17), then the thermal printing time 63 for the printing of the next time (T9 in FIG. 5A) is calculated in the similar manner at step S19.

If the value of the buffer count of the previous time (T2 in FIG. 5A) is smaller (YES at step S12) than the value of the buffer count of the present time (T5 in FIG. 5A), then it is determined whether or not the value of the count of the previous time is not less than 8 at step S13. If the value of the buffer count of the previous time is not less than 8 (YES at step S13), then the value of the count of the previous time is stored in the register at step S16. Then, the thermal printing time 63 for the printing of the next time (T9 in FIG. 5A) is calculated in the similar manner at step S19.

If on the other hand the value of the buffer count of the previous time (T2 in FIG. 5A) is smaller than "8" (NO at step S13), the value of the buffer count of the previous time is incremented by 1 and the resultant value is stored in the register as the value of the determined buffer count at step S16. After the value of the thus determined buffer count is stored in the register, then the thermal printing time 63 for the printing of the next time (T9 in FIG. 5A) is calculated from the data table 45*a* in the similar procedure.

When the value of the buffer count of the previous time (T2 in FIG. 5A) is "3" and the value of the buffer count of the present time (T5 in FIG. 5A) is "5", a value "4" of the buffer count is stored in the register. Thus, the thermal printing time 63 of the next time is determined as any one of "4+a4j" ms in response to the value "4" stored within the register and the heat temperature detected at time T6.

Figure 6:
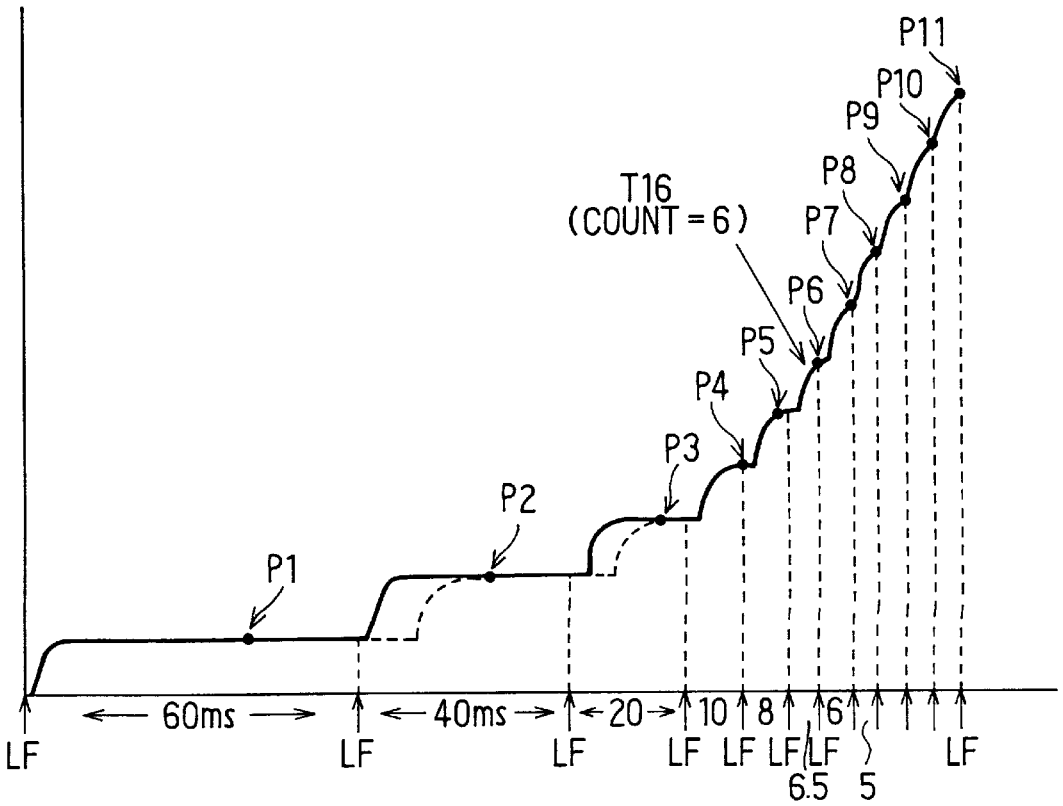
FIG. 6 is a time chart showing operation of the thermal printer apparatus.
Figure 7:
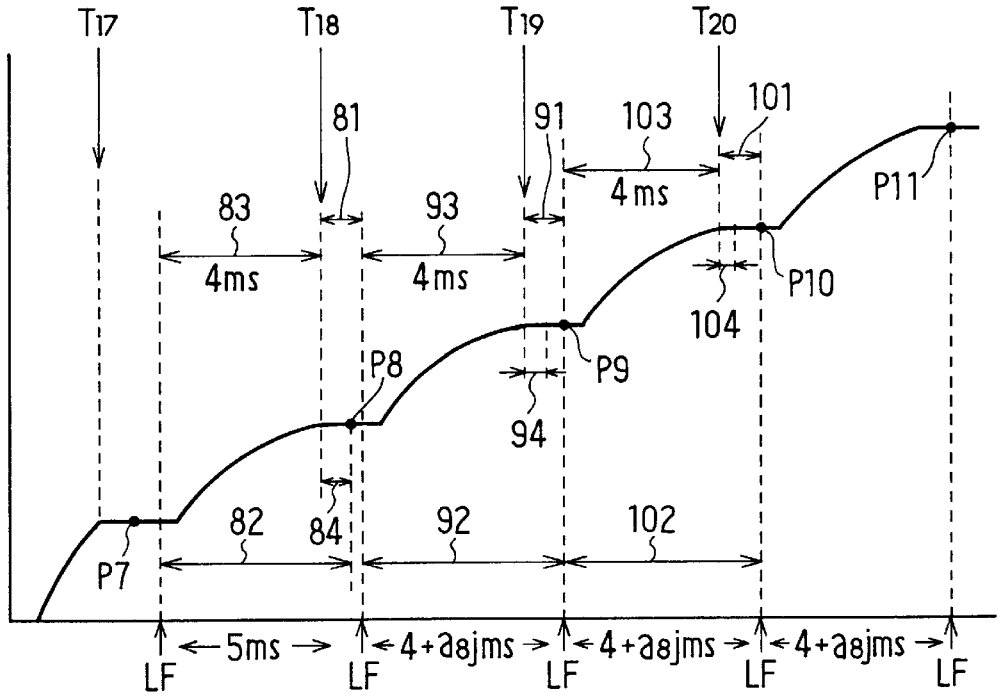
FIG. 7 is an enlarged time chart showing a part of the operation of the thermal printer apparatus shown in FIG. 6.
Figure 8A:
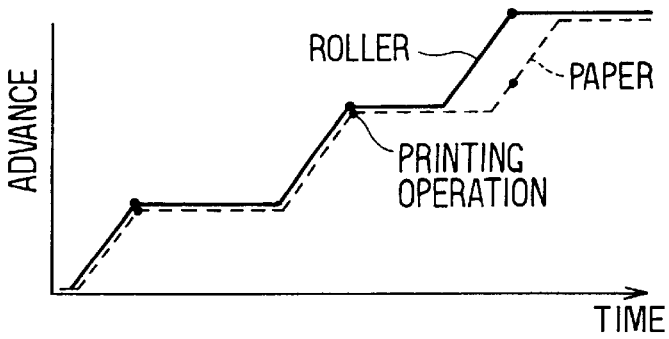
FIG. 8A PRIOR ART
FIG. 8A is a time chart showing operation of a conventional thermal printer apparatus.
Figure 8B:
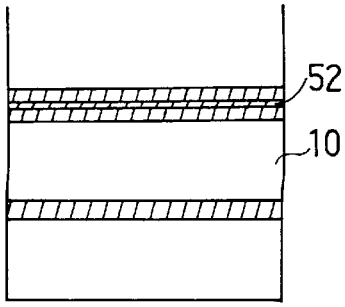
FIG. 8B PRIOR ART
FIG. 8B is a schematic view showing a thermal paper printed by the conventional thermal printer apparatus.

Here, the value of the buffer count is set to "8" at step S18 when the value of the buffer count stored in the register at step S16 during the above thermal printing time determination routine 45*b* is executed indicates the value not less than "8". The reason for this that, as shown in FIG. 6, even when the stop time becomes shorter than a constant time "1" ms, the thermal printing process can be executed after a constant thermal printing time "4+a8j" ms elapsed uniformly. In this case, as shown in FIG. 7, the advancing interval becomes uniformly "4+a8j" ms.

As described above, during a time period from T6 to T7, when the thermal printing time 63 of the next time T9 is determined by the thermal printing time determination routine 45*b,* the determined thermal printing time 63 of the next time is stored in the thermal printing time memory area 46*b* at step S20. The count of the stored thermal printing time 63 of the next time is started from time T7 by the RTC 39 and the clock generator 40 as will be described below.

In step S21 following the printing time determination routine at step S10 (FIG. 4), if the printing is to be continued (YES at step S21), then after the stop time 65 of the feeder roller 19 elapsed (YES at step S23) at time T7, the CPU 33 outputs the paper advance signal to the head controller 36, whereby the rotation of the feeder roller 19 is started.

Also, the CPU 33 reads out the above present thermal printing time 63 from the thermal printing time memory area 46*b* at time T7. Then, the CPU 33 transmits a signal in such a manner that the RTC 39 and the clock generator 40 start the counting of the present thermal printing time 63 from time T7. With a very small delay time after the head controller 36 received the paper advance signal, the rotation of the feeder roller 19 is started at step S3. Then, after the thermal printing time elapsed from time T7, i.e., at time T9, the head controller 36 transmits the thermal printing process start signal to the printer head 12, whereby the printer head 12 effects the thermal printing process on the thermal paper 10. Thus, step S5 in the above process detects the amount of data to be printed, and step S8 variably controls the thermal printing operation.

Even when the thermal paper 10 sticks to the heating element 18, the thermal printing process is executed after the predetermined thermal printing time (delay time) elapsed. Thus, after the thermal paper 10 is detached from the heating element 18 and is reliably moved to the predetermined position, the thermal printing can be executed. Accordingly, as shown in FIG. 5B, the thermal printing can be prevented from being effected at the printed position so that the printing in the advancing direction (sub-scanning direction) can be executed at the equal interval 51 and the thermally printed images 52 are separated from line to line.

It is assumed here that, as shown in FIG. 6, as the image data to be printed is sequentially stored in the buffer 46*d* from the start of the advancing process, the value of the buffer count progressively increases and the paper advancing interval is reduced. That is, data amount of the buffer 46*d* decreases in accordance with the increase of the value of the buffer count.

In FIG. 6, printing timing or points P1 to P3 denote a case when the amount of received data such as a photograph is very large, printing points P4 to P8 denote a case when the amount of received data such as graphics is relatively large and reference numeral 9 and printing points P9 to P11 denote a case when the amount of received data such as characters is relatively small. As characters or the like have a small data amount as compared with the data amount of the photograph or the like, the time in which image data is stored in one line of the buffer 43 is relatively short. Accordingly, as shown in FIG. 7, the paper advancing interval becomes constant after the printing point P8 and the following printing points.

In FIG. 7, the printing point P8 indicates that the thermal printing process is executed after a thermal printing time 82 elapsed. Here, since the value of the buffer count at time T16 is "6" as shown in FIG. 6 and the value of the buffer count at time T17 is "7" as shown in FIG. 7, if the thermal printing time 82 is calculated by the above thermal printing time determination routine 45*b,* then the thermal printing time becomes "4+a7j" ms. A delay time 84 is "a7j", and the stop time 81 is determined to be "1" ms from the above table because the value of the buffer count at time T18 is "8". Here, reference numeral 83 indicates a time interval in which the head controller 36 receives the paper advance signal from the CPU 33 and the feeder roller 19 is stopped similarly as above.

The printing point P9 indicates the thermal printing process executed after the thermal printing time 92 elapsed. Here, since the value of the buffer count at time T17 is "7" and the value of the buffer count at time T18 is "8", if a thermal printing time 92 is calculated by the above thermal printing time determination routine 45*b,* then the thermal printing time 92 becomes "4+a8j" ms. Since the delay time 91 is "a8j" ms and the stop time 94 is a value k ($8<k\leqq 13$) of the buffer count at time T19, the delay time 91 becomes shorter than 1 ms. In the printing points following the printing point P9, since the value "k" of the buffer count "k" indicates "8<k", the stop time decreases in accordance with the increase of the value of the buffer count and becomes shorter than the delay time. However, the delay time is uniformly set as "a8j" ms.

If the value "k" ($8<k\leqq 13$) of the buffer count at time T20 is larger than the value "k" of the buffer count at time T19, then a stop time 104 becomes shorter than the stop time 94. However, a delay time 101 is uniformly set to "a8j" ms from the printing point P9 and the following printing points as described above. Thus, in the thermal printer apparatus 1 according to the embodiment, the paper advancing interval is changed in accordance with the received data amount. In particular, when the data amount is relatively small as in the case of the above printing point P9 and the following points, the advancing interval becomes short. Hence, the thermal printing process can be executed in a short period of time.

While the above embodiment uses the buffer 46*d* of 13 lines, it is possible to use a buffer of other lines. Further, while the stop time is "56" ms when the value of the buffer count is "1", the stop time may be changed depending upon the size of the buffer 46*d,* the received data amount, the process speed or the like. Therefore, when a document such as a photograph having a high resolution, for example, is received, even if the value of the buffer count indicates "1", the stop time is not limited to "56" ms. Furthermore, while the delay time is determined from the stop time and the printer head temperature, the stop time and the delay time may be associated with each other by one-to-one relation and the delay time may be determined without referring to the head temperature.

While the data table 45*a* and the thermal printing time determination routine 45*b* are previously stored in the memory 34 in the above embodiment, a thermal printer control program which enables a computer to execute the thermal printing time determination routine may be recorded on any other record medium such as a magnetic tape, a magnetic disk or an optical disk as long as the program is readable by the computer associated with the printer apparatus.

Further, the thermal printing time determination routine 45*b* may be executed by using these record media. In this case, if the thermal printer apparatus 1 may be connected to an information process apparatus such as a personal computer. By reading the thermal printing control program from the record medium, the information process apparatus such as the personal computer may execute the thermal printing time determination routine 45*b.* Thus, even when the thermal paper 10 sticks to the heating element 18, the thermal printing process may be executed after the thermal paper 10 separates from the heating element 18 and advanced to the predetermined position. Accordingly, since the thermal printing process can be prevented from being effected at the position which was once printed, the occurrence of printed image dropout or the like can be prevented, and the printing quality can be improved.

The thermal printer apparatus according to the present invention is not limited to the facsimile machine 2, but may be apparatus such as a printer for effecting a thermal printer. Furthermore, the thermal printer apparatus is not limited to the apparatus in which data is printed on the thermal paper by using the thermal printer head having the heating element, but may be an apparatus of a heat transfer system using an ink ribbon.

Having described a preferred embodiment of the invention with reference to the accompanying drawings, it is to be understood that the invention is not limited to the disclosed embodiment and the modifications and that various changes and modifications could be effected further without departing from the spirit of the invention.

What is claimed is:

1. A thermal printer apparatus for printing an image on a predetermined area of a printable medium by repeating a thermal printing process for printing an image on the printable medium by heating the printable medium with a printer head and an advancing process for advancing the printable medium at a unit of predetermined length, the apparatus comprising:

time count means for determining a stop time of the printable medium after a previous advancing process;

delay means for determining a delay time in correspondence with the determined stop time; and control means for effecting a next thermal printing process after the determined delay time elapses from a completion of a next advancing process following the previous advancing process.

2. The thermal printer apparatus according to claim 1, further comprising:

relation memory means for memorizing a relation between delay time and stop time, wherein the control means determines the delay time from the memorized relation based on the determined stop time.

3. The thermal printer apparatus according to claim 2, further comprising:

printing data memory means for storing data to be printed in the thermal printing process; and data amount detecting means for detecting amount of data stored in the printing data memory means, wherein the relation memory means memorizes the stop time in association with the amount of data stored in the printing data memory means, and the time count means determines the stop time from the relation memory means based on a data amount detected by the data amount detecting means.

4. The thermal printer apparatus according to claim 2, further comprising:

temperature detecting means for detecting a temperature of the printer head, wherein the relation memory means memorizes the relation in further correspondence with the temperature of the printer head, and the delay means determines the delay time from the relation memory means based on the determined stop time and the detected temperature of the printer head.

5. A program medium for recording therein a computer readable control program for a thermal printer which repeats a thermal printing process for printing an image on a printable medium by heating the printable medium with a printer head and an advancing process for advancing the printable medium at a unit of predetermined length, the program medium comprising:

a first storage area storing a stop time determination program for determining a stop time of the printable medium after a previous advancing process;

a second storage area storing a delay time determination program for determining a delay time in correspondence with the determined stop time; and a third storage area storing a timing determination program for determining a timing of effecting a next thermal printing process after the determined delay time elapses from a completion of a next advance process following the previous advancing process.

6. A control method for a printer having a paper advancing mechanism for advancing a paper and a printer head for printing an image on the paper, the control method comprising the steps of:

receiving data to be printed on the paper;

determining a delay time variable with a parameter related to sticking of the paper to the printer head;

driving the paper advancing mechanism to advance the paper to a next printing position;

effecting a printing operation of the printer head after an elapse of the determined delay time from a stop of the paper advancing mechanism.

7. The control method according to claim 6, further comprising the step of:

detecting a temperature of the printer head, wherein the determining step determines the delay time in accordance with the detected temperature.

8. The control method according to claim 7, wherein:

the determining step determines the delay time in accordance with the detected temperature and an amount of the received data.

9. The control method according to claim 6, wherein:

the determining step determines the delay time in accordance with an amount of the received data.

10. The control method according to claim 9, further comprising the step of:

determining a time interval to disable the paper advancing operation of the paper driving mechanism in accordance with an amount of data to be printed.

11. The control method according to claim 9, further comprising the step of:

determining a time interval between two successive paper advancing operations of the paper driving mechanism in accordance with an amount of data to be printed.

12. The control method according to claim 6, wherein:

the determining step includes a step of reading the delay time from a data table storing a relation between the parameter and the delay time.

* * * * *